US007729833B2

(12) United States Patent
Brickner et al.

(10) Patent No.: US 7,729,833 B2
(45) Date of Patent: Jun. 1, 2010

(54) IMPLEMENT CONTROL SYSTEM BASED ON INPUT POSITION AND VELOCITY

(75) Inventors: Chad T. Brickner, Aurora, IL (US); Christopher K. Hoadley, Kewanee, IL (US); Brett J. Janson, E. Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 842 days.

(21) Appl. No.: 11/518,128

(22) Filed: Sep. 11, 2006

(65) Prior Publication Data

US 2008/0065297 A1 Mar. 13, 2008

(51) Int. Cl.
*E02F 9/22* (2006.01)

(52) U.S. Cl. ..... 701/50; 37/414

(58) Field of Classification Search ..... None
See application file for complete search history.

(56) References Cited

U.S. PATENT DOCUMENTS

| | | | | |
|---|---|---|---|---|
| 4,077,490 | A | 3/1978 | Casterton et al. | |
| 4,253,540 | A | 3/1981 | Berg | |
| 4,476,954 | A | 10/1984 | Johnson et al. | |
| 4,914,592 | A | 4/1990 | Callahan et al. | |
| 5,899,008 | A | 5/1999 | Cobo et al. | |
| 5,979,587 | A | 11/1999 | Liubakka et al. | |
| 6,047,228 | A * | 4/2000 | Stone et al. | 701/50 |
| 6,061,617 | A | 5/2000 | Berger et al. | |
| 6,202,014 | B1 | 3/2001 | Brandt et al. | |
| 6,293,033 | B1 * | 9/2001 | Moriya et al. | 37/348 |
| 6,725,105 | B2 | 4/2004 | Francis et al. | |
| 6,785,596 | B2 | 8/2004 | Brandt et al. | |
| 6,959,970 | B2 | 11/2005 | Tseng | |
| 6,986,727 | B2 | 1/2006 | Kuras et al. | |
| 2004/0159230 | A1 | 8/2004 | Tabor | |
| 2005/0085282 | A1 | 4/2005 | Ho et al. | |
| 2005/0177292 | A1 | 8/2005 | Okamura et al. | |
| 2006/0047394 | A1 * | 3/2006 | Price et al. | 701/50 |
| 2007/0119159 | A1 * | 5/2007 | Egelja et al. | 60/420 |

FOREIGN PATENT DOCUMENTS

| | | |
|---|---|---|
| DE | 195 18 431 | 11/1996 |
| FR | 2868173 | 9/2005 |

(Continued)

*Primary Examiner*—Michael J. Zanelli
(74) *Attorney, Agent, or Firm*—Finnegan, Henderson, Farabow, Garrett & Dunner, LLP

(57) ABSTRACT

A hydraulic control system for a machine having a work implement is disclosed. The hydraulic control system has a fluid actuator configured to move the work implement. The control system also has an operator interface device configured to generate at least one signal in response to a movement of the operator interface device. The control system further has a valve assembly for controllably providing hydraulic fluid flow to the fluid actuator to affect movement of the fluid actuator. The hydraulic control system has a controller configured to communicate with the valve assembly and the operator interface device. The controller is also configured to receive a signal, determine a velocity input associated with the movement of the operator interface device based on the received signal, and determine a desired fluid actuator velocity based on the determined velocity input. The controller is further configured to generate a command signal corresponding to the desired fluid actuator velocity and to direct the command signal to the valve assembly.

14 Claims, 3 Drawing Sheets

FOREIGN PATENT DOCUMENTS

| | | |
|---|---|---|
| GB | 2281638 | 3/1995 |
| GB | 2419429 | 4/2006 |
| JP | 11350538 | 12/1999 |
| JP | 2001020325 | 1/2001 |
| JP | 2005-144579 | 6/2005 |
| WO | WO 98/06936 | 2/1998 |

* cited by examiner

IMPLEMENT CONTROL SYSTEM BASED ON INPUT POSITION AND VELOCITY

TECHNICAL FIELD

The present disclosure relates generally to an implement control system, and more particularly, to an implement control system based on input position and velocity.

BACKGROUND

Machines such as, for example, excavators, loaders, dozers, motor graders, and other types of heavy machinery use multiple hydraulic actuators to accomplish a variety of tasks. These actuators are typically velocity controlled to move a work tool at a speed based on an actuation position of an operator interface device. For example, an operator interface device such as a joystick, a pedal, or any other suitable operator interface device may be movable to a position to generate a signal corresponding to that position that is indicative of a desired velocity of an associated hydraulic actuator. When an operator moves the interface device to that specific position, the operator expects the hydraulic actuator to move at the corresponding predetermined velocity.

One example of this type of system is described in U.S. Pat. No. 5,899,008 (the '008 patent) issued to Cobo et al. on Apr. 4, 1999. The '008 patent describes an apparatus for controllably moving a work implement connected to a machine based on positional feedback. Specifically, the apparatus of the '008 patent includes an operator controlled joystick that generates an operator command signal in response to a moved position of the joystick. The signal is indicative of a desired velocity and initiates the controlled flow of hydraulic fluid to lift and tilt cylinders to move the cylinders in accordance with the desired velocity. Cylinder position sensors produce cylinder position signals in response to the position of the lift and tilt cylinders. A controller receives the operator command and cylinder position signals and responsively produces a pump command signal to change the displacement of a variable displacement pump, thereby regulating the movement speed of the hydraulic cylinders to match the desired velocity.

Although the '008 patent may provide predictable implement movement velocity, the apparatus of the '008 patent may be less responsive and less intuitive than desired by an operator of the machine. That is, there may be times when an operator desires only small movements of the lift and/or tilt cylinders, but at a high velocity. In this situation, a position only based control system may be unsatisfactory. Further, it may be more intuitive for the movement speed of the implement system to be at least partially based on the movement speed of the joystick.

The disclosed control system is directed to overcoming one or more of the problems set forth above.

SUMMARY OF THE INVENTION

In one aspect, the present disclosure is directed to a hydraulic control system for a machine having a work implement. The hydraulic control system includes a fluid actuator configured to move the work implement, and an operator interface device configured to generate at least one signal in response to a movement of the operator interface device. The control system also includes a valve assembly for controllably providing hydraulic fluid flow to affect movement of the fluid actuator. The control system further includes a controller in communication with the valve assembly and the operator interface device. The controller is configured to receive the at least one signal, and determine a velocity input associated with the movement of the operator interface device based on the received at least one signal. The controller is also configured to determine a desired fluid actuator velocity based on the velocity input, generate a command signal corresponding to the desired fluid actuator velocity, and direct the command signal to the valve assembly.

In another aspect, the present disclosure is directed to method of operating a hydraulic system for a machine having a work implement. The method includes receiving an operator input signal and determining a velocity input associated with the received operator input signal. The method also includes determining a desired implement velocity based on the velocity input, and generating a command signal for controllably providing hydraulic fluid flow to move the work implement based on the desired implement velocity.

DETAILED DESCRIPTION

Figure 1:
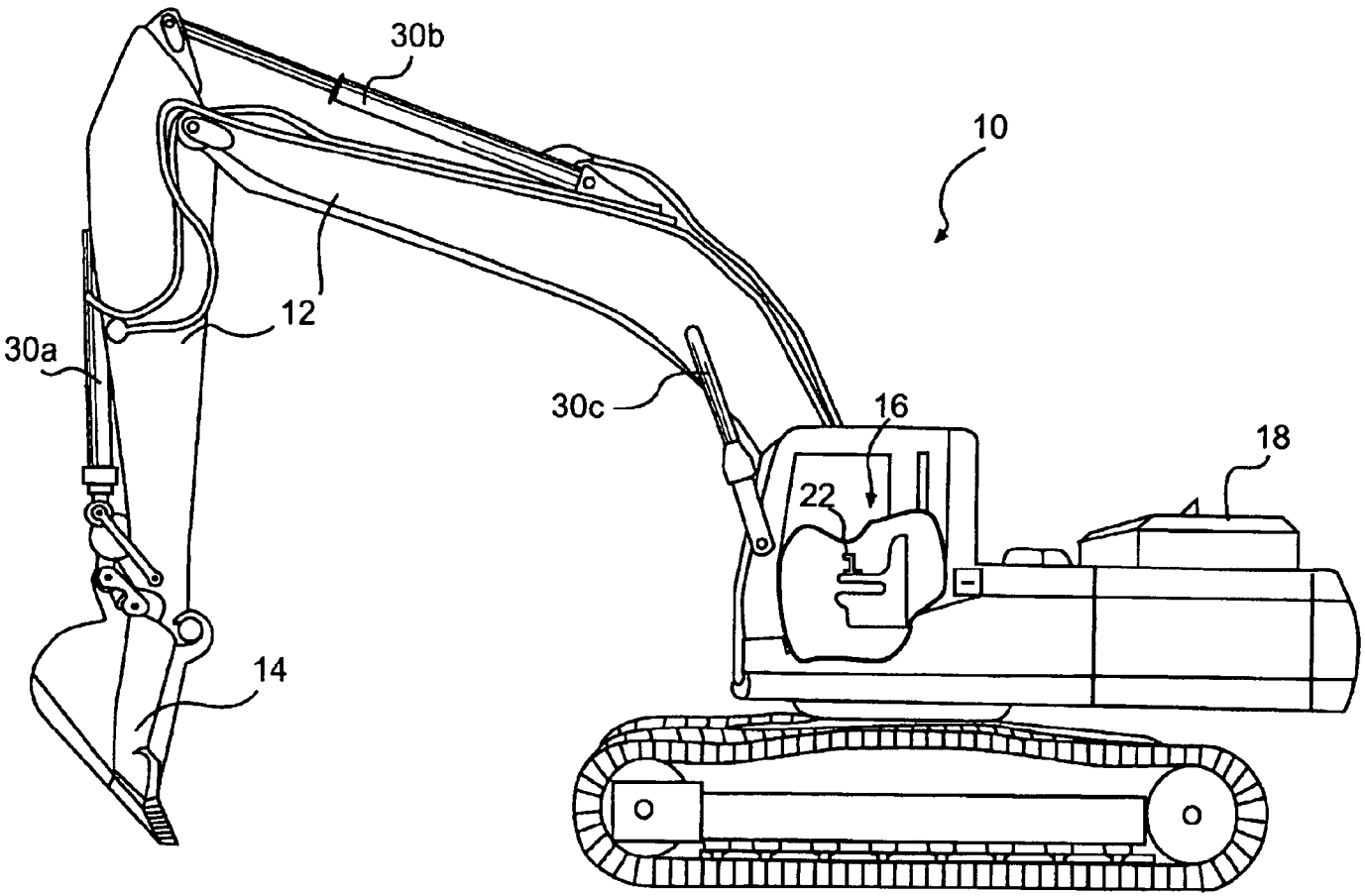
FIG. 1 is a side-view diagrammatic illustration of an exemplary disclosed machine.

FIG. 1 illustrates an exemplary machine 10 having multiple systems and components that cooperate to accomplish a task. Machine 10 may be a fixed or mobile machine that performs some type of operation associated with an industry such as mining, construction, farming, transportation, or any other industry known in the art. For example, machine 10 may be an earth moving machine such as an excavator, a dozer, a loader, a backhoe, a motor grader, a dump truck, or any other earth moving machine. Machine 10 may include a frame 12, a work implement 14 removably attachable to machine 10, one or more hydraulic actuators 30*a-c* connecting work implement 14 to frame 12, a power source 18, and an operator station 16. Operator station 16 may allow an operator to control work implement 14.

Frame 12 may include any structural unit that supports movement of machine 10. Frame 12 may embody, for example, a stationary base frame connected to power source 18, a movable frame member of a linkage system, or any other frame known in the art.

Numerous different work implements 14 may be attachable to a single machine and controllable via operator station 16. Work implement 14 may include any device used to perform a particular task such as, for example, a bucket, a fork arrangement, a dozing blade, a shovel, a ripper, a dump bed, a broom, a snow blower, a propelling device, a cutting device, a grasping device, or any other task-performing device known in the art. Work implement 14 may be connected to machine 10 via a direct pivot, via a linkage system, via one or more hydraulic cylinders, via a motor, or in any other appropriate manner. Work implement 14 may pivot, rotate, slide, swing, lift, or move relative to machine 10 in any manner known in the art.

Power source 18 may be an engine such as, for example, a diesel engine, a gasoline engine, a gaseous fuel-powered engine such as a natural gas engine, or any other engine known in the art. It is contemplated that power source 18 may alternatively be another source of power such as a fuel cell, a power storage device, an electric or hydraulic motor, or another source of power known in the art. Power source 18 may produce a mechanical or electrical power output that may then be converted to hydraulic power for moving hydraulic components in machine 10.

Operator station 16 may receive input from a machine operator indicative of a desired work implement movement to be performed by work implement 14. Specifically, operator station 16 may include an operator interface device 22 embodied as a single or multi-axis joystick located to one side of an operator station and/or within proximity of an operator seat. Operator interface device 22 may be a proportional-type controller configured to position and/or orient work implement 14 and to produce an interface device position signal indicative of an operator's manipulation thereof. It is further contemplated that additional and/or different operator interface devices may be included within operator station 16 such as, for example, wheels, knobs, push-pull devices, switches, pedals, and other operator interface devices known in the art.

For example, operator interface device 22 may generate a position signal, corresponding to an actuated position of the device. That is, as operator input device 22 is moved away from a neutral axis toward a maximum tilt position, operator input device 22 may generate a signal corresponding to a percent of the distance traveled from the neutral position to a maximum position. It is contemplated that operator interface device 22 may include a position sensor, configured to provide this signal in response to manipulation by the operator.

Operator interface device 22 may also produce a signal indicative of an input velocity corresponding to the speed of the operator's manipulation of interface device 22. For example, as operator input device 22 is moved from the neutral position toward the maximum position, the speed of this movement may be detected or determined, and a signal may be generated in response thereto. Operator interface device 22 may include a velocity sensor, configured to measure this velocity of the operator interface device 22 and produce the signal. Alternatively, the position signal provided by the position sensor described above may in turn be used to determine the input velocity.

Figure 2:
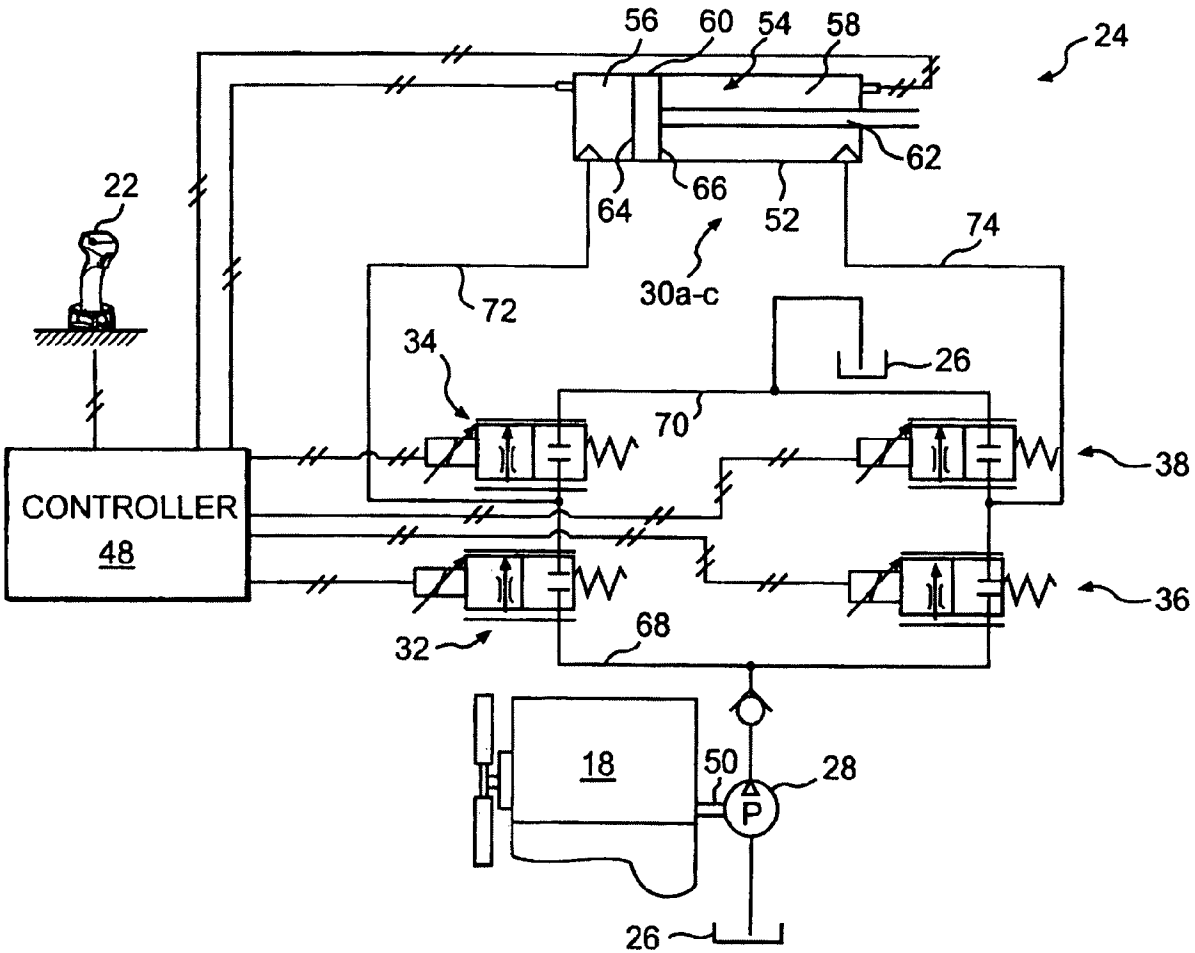
FIG. 2 is a schematic illustration of an exemplary disclosed hydraulic control system for the machine of FIG. 1.

As illustrated in FIG. 2, machine 10 may include a hydraulic control system 24 having a plurality of fluid components that cooperate to move work implement 14 (referring to FIG. 1). Specifically, hydraulic control system 24 may include a tank 26 holding a supply of fluid, and a source 28 configured to pressurize the fluid and direct the pressurized fluid to hydraulic actuators 30*a-c*. While FIG. 1 depicts three actuators, identified as 30*a*, 30*b*, and 30*c*, for the purposes of simplicity, the hydraulic schematic of FIG. 2 depicts only one actuator. Hydraulic control system 24 may also include a head-end supply valve 32, a head-end drain valve 34, a rod-end supply valve 36, and a rod-end drain valve 38. Hydraulic control system 24 may further include a controller 48 in communication with the fluid components of hydraulic control system 24 and operator input device 22. It is contemplated that hydraulic control system 24 may include additional and/or different components such as, for example, accumulators, restrictive orifices, check valves, pressure relief valves, makeup valves, pressure-balancing passageways, temperature sensors, position sensors, speed sensors, and other components known in the art. It is further contemplated that, instead of being separate independent valves, head and rod-end supply and drain valves 32-38 may alternatively be embodied in one or more valve mechanisms performing both supply and drain valve functions.

Tank 26 may constitute a reservoir configured to hold a supply of fluid. The fluid may include, for example, a dedicated hydraulic oil, an engine lubrication oil, a transmission lubrication oil, or any other fluid known in the art. One or more hydraulic systems within machine 10 may draw fluid from and return fluid to tank 26. It is also contemplated that hydraulic control system 24 may be connected to multiple separate fluid tanks.

Source 28 may be configured to produce a flow of pressurized fluid and may include a pump such as, for example, a variable displacement pump, a fixed displacement pump, or any other source of pressurized fluid known in the art. Source 28 may be drivably connected to power source 18 of machine 10 by, for example, a countershaft 50, a belt (not shown), an electrical circuit (not shown), or in any other suitable manner. Alternatively, source 28 may be indirectly connected to power source 18 via a torque converter, a gear box, or in any other manner known in the art. It is contemplated that multiple sources of pressurized fluid may be interconnected to supply pressurized fluid to hydraulic control system 24.

Hydraulic actuators 30*a-c* may include fluid cylinders that connect work implement 14 to frame 12 via a direct pivot, via a linkage system with hydraulic actuators 30*a-c* forming members in the linkage system (referring to FIG. 1), or in any other appropriate manner. It is contemplated that hydraulic actuators other than fluid cylinders may alternatively be implemented within hydraulic control system 24 such as, for example, hydraulic motors or any other hydraulic actuator known in the art. As illustrated in FIG. 2, each of hydraulic actuators 30*a-c* may include a tube 52 and a piston assembly 54 disposed within tube 52. One of tube 52 and piston assembly 54 may be pivotally connected to frame 12, while the other of tube 52 and piston assembly 54 may be pivotally connected to work implement 14. It is contemplated that tube 52 and/or piston assembly 54 may alternatively be fixedly connected to either frame 12 or work implement 14. Each of hydraulic actuators 30*a-c* may include a first chamber 56 and a second chamber 58 separated by a piston 60. First and second chambers 56, 58 may be selectively supplied with pressurized fluid from source 28 and selectively connected with tank 26 to cause piston assembly 54 to displace within tube 52, thereby changing the effective length of hydraulic actuators 30*a-c*. The expansion and retraction of hydraulic actuators 30*a-c* may function to assist in moving work implement 14.

Piston assembly 54 may include piston 60 being axially aligned with and disposed within tube 52, and a piston rod 62 connectable to one of frame 12 and work implement 14 (referring to FIG. 1). Piston 60 may include a first hydraulic surface 64 and a second hydraulic surface 66 opposite first hydraulic surface 64. An imbalance of force caused by fluid pressure on first and second hydraulic surfaces 64, 66 may result in movement of piston assembly 54 within tube 52. For example, a force on first hydraulic surface 64 being greater than a force on second hydraulic surface 66 may cause piston assembly 54 to displace to increase the effective length of hydraulic actuators 30*a-c*. Similarly, when a force on second hydraulic surface 66 is greater than a force on first hydraulic surface 64, piston assembly 54 will retract within tube 52 to decrease the effective length of hydraulic actuators 30*a-c*. A flow rate of fluid into and out of first and second chambers 56 and 58 may determine a velocity of hydraulic actuators 30*a-c*, while a pressure of the fluid in contact with first and second hydraulic surfaces 64 and 66 may determine an actuation force of hydraulic actuators 30*a-c*. A sealing member (not shown), such as an o-ring, may be connected to piston crown 60 to restrict a flow of fluid between an internal wall of tube 52 and an outer cylindrical surface of piston crown 60.

Head-end supply valve 32 may be disposed between source 28 and first chamber 56 to regulate a flow of pressurized fluid to first chamber 56 in response to a command signal from controller 48. Specifically, head-end supply valve 32 may include a proportional spring biased valve mechanism that is solenoid actuated to move between a first position at which fluid is allowed to flow into first chamber 56 and a second position at which fluid flow is blocked from first chamber 56. Head-end supply valve 32 may be movable to any position between the first and second positions to vary the rate of flow into first chamber 56, thereby affecting the velocity of hydraulic actuators 30*a-c*. It is contemplated that head-end supply valve 32 may alternatively be hydraulically actuated, mechanically actuated, pneumatically actuated, or actuated in any other suitable manner.

Head-end drain valve 34 may be disposed between first chamber 56 and tank 26 to regulate a flow rate of fluid from first chamber 56 to tank 26 in response to the command signal from controller 48. Specifically, head-end drain valve 34 may include a proportional spring biased valve mechanism that is solenoid actuated to move between a first position at which fluid is allowed to flow from first chamber 56 and a second position at which fluid is blocked from flowing from first chamber 56. Head-end drain valve 34 may be movable to any position between the first and second positions to vary the rate of flow from first chamber 56, thereby affecting the velocity of hydraulic actuators 30*a-c*. It is contemplated that head-end drain valve 34 may alternatively be hydraulically actuated, mechanically actuated, pneumatically actuated, or actuated in any other suitable manner.

Rod-end supply valve 36 may be disposed between source 28 and second chamber 58, to regulate a flow of pressurized fluid to second chamber 58 in response to the command signal from controller 48. Specifically, rod-end supply valve 36 may include a proportional spring biased valve mechanism that is solenoid actuated to move between a first position at which fluid is allowed to flow into second chamber 58 and a second position at which fluid is blocked from second chamber 58. Rod-end supply valve 36 may be movable to any position between the first and second positions to vary the rate of flow into second chamber 58, thereby affecting the velocity of hydraulic actuators 30*a-c*. It is contemplated that rod-end supply valve 36 may alternatively be hydraulically actuated, mechanically actuated, pneumatically actuated, or actuated in any other suitable manner.

Rod-end drain valve 38 may be disposed between second chamber 58 and tank 26 to regulate a flow of fluid from second chamber 58 to tank 26 in response to the command velocity from controller 48. Specifically, rod-end drain valve 38 may include a proportional spring biased valve mechanism that is solenoid actuated to move between a first position at which fluid is allowed to flow from second chamber 58 and a second position at which fluid is blocked from flowing from second chamber 58. Rod-end drain valve 38 may be movable to any position between the first and second positions to vary the rate of flow from second chamber 58, thereby affecting the velocity of hydraulic actuators 30*a-c*. It is contemplated that rod-end drain valve 38 may alternatively be hydraulically actuated, mechanically actuated, pneumatically actuated, or actuated in any other suitable manner.

Head and rod-end supply and drain valves 32-38 may be fluidly interconnected. In particular, head and rod-end supply valves 32, 36 may be connected in parallel to a common supply passageway 68 extending from source 28. Head and rod-end drain valves 34, 38 may be connected in parallel to a common drain passageway 70 leading to tank 26. Head-end supply and drain valves 32, 34 may be connected in parallel to a first chamber passageway 72 for selectively supplying and draining first chamber 56 in response to the command signal from controller 48. Rod-end supply and drain valves 36, 38 may be connected in parallel to a common second chamber passageway 74 for selectively supplying and draining second chamber 58 in response to the command signal from controller 48.

Controller 48 may embody a single microprocessor or multiple microprocessors that include a means for controlling an operation of hydraulic control system 24. Numerous commercially available microprocessors can be configured to perform the functions of controller 48. It should be appreciated that controller 48 could readily be embodied in a general machine microprocessor capable of controlling numerous machine functions. Controller 48 may include a memory, a secondary storage device, a processor, and any other components for running an application. Various other circuits may be associated with controller 48 such as power supply circuitry, signal conditioning circuitry, solenoid driver circuitry, and other types of circuitry.

Controller 48 may include one or more maps relating the interface device position and velocity signals, desired work implement velocity, associated flow rate, and/or corresponding valve element position for controlling hydraulic system 24. Controller 48 may also include one or more maps relating an input velocity to a predetermined gain, as well as relating an input position to a desired fluid actuator velocity. Each of these maps may include a collection of data in the form of tables, graphs, and/or equations.

In one example, desired velocity and command flow rate may form the coordinate axis of a 2-D table for control of the first and second chamber supply elements. The commanded flow rate required to move the fluid actuators at the desired velocity and valve element position of the appropriate supply elements or corresponding power supply current may be related in another separate 2-D map or together with a desired velocity in a single 3-D map. It is also contemplated that desired velocity may be directly related to the valve element position or supply current in single 2-D map.

Controller 48 may be configured to allow the operator to directly modify these maps and/or select specific maps from available relationship maps stored in the memory of controller 48 to affect fluid actuator motion. It is also contemplated that the maps may also be selectable based on modes of machine operation.

Controller 48 may receive a position input signal from operator interface device 22. As described above, the position input signal may be generated by operator interface device 22 and correspond to an actuated position of the interface device. Controller 48 may then reference the selected and/or modified relationship maps stored in the memory of controller 48 to determine a desired work tool velocity corresponding to the received position signal.

Controller 48 may also receive a signal indicative of the input velocity. As described above, this input velocity may represent the speed at which the operator of machine 10 moves the operator interface device 22 from a neutral or reference position to a new position. Controller 48 may then reference the selected and/or modified relationship maps stored in the memory of controller 48 to determine a desired work tool velocity offset value corresponding to the received input velocity signal.

The desired offset value may be predetermined for controlling the aggressiveness of the response in hydraulic system 24. The desired offset value may have predetermined lower and upper limits, established in advance for balancing responsiveness and stability in hydraulic system 24. For example, establishing a low desired velocity offset may produce a proportionally stable operation of hydraulic system 24, but the system 24 may not reflect a desired responsiveness.

Instead, if a high desired velocity offset is established for the operation of hydraulic system 24, it may increase responsiveness, but affect system stability.

To accommodate these requirements, the desired velocity offset may be constant when input velocity is low (i.e., below a predetermined threshold) and proportional to the input velocity when the input velocity is high (i.e., above the predetermined threshold). The desired offset value may be found by reference to the maps stored in the memory of controller 48. The desired offset value may also be calculated according to Eq. 1, shown below.

$$DVO_v = IV \times K \quad \text{Eq. 1}$$

wherein:

$DVO_v$ is a desired work tool velocity offset value;

IV is a variable associated with an input velocity; and

K is a predetermined gain value.

Controller 48 may then calculate a modified desired velocity, which may be a combination of the position-based and velocity offset desired values, according to Eq. 2, shown below.

$$DV_p + DVO_v = MDV \quad \text{Eq. 2}$$

wherein:

$DV_p$ is a variable associated with a desired work tool velocity based on positional input $DVO_v$ is a variable associated with a desired work tool velocity offset based on input velocity; and MDV is a modified desired velocity Controller 48 may then reference the selected and/or modified relationship maps stored in the memory of controller 48 to determine flow rate value and/or associated positions for each of the supply and drain elements within valves 32-38 according to the modified input signal (MDV), which may be the combination of the position and velocity input signals.

A command signal may be generated and sent to the valve assembly based on the determined flow rate value or position signal. The command signal may cause the appropriate supply and drain elements to fill and drain first and second chambers 56-58 at a rate that results in the modified desired fluid actuator velocity.

INDUSTRIAL APPLICABILITY

The disclosed control system may be applicable to a hydraulic implement system where response is important. The disclosed control system may provide improved response by using both a position and a velocity command input by an operator. This improved control structure may facilitate an increase in production and efficiency of machine 10. The operation of the hydraulic control system 24 will now be explained.

During operation of machine 10, a machine operator may manipulate operator interface device 22 to create a movement of work implement 14. The actuation position and movement velocity of operator interface device 22 may be related to an operator expected or desired response of machine 10 or work implement 14. Operator interface device 22 may generate a position signal indicative of the operator expected or desired response during operator manipulation. Operator interface device 22 may also generate a velocity signal and then send both signals to controller 48. Alternatively, the operator interface device 22 may generate only a position signal and controller 48 may determine the input velocity through derivation of the position signal with respect to time.

Figure 3:
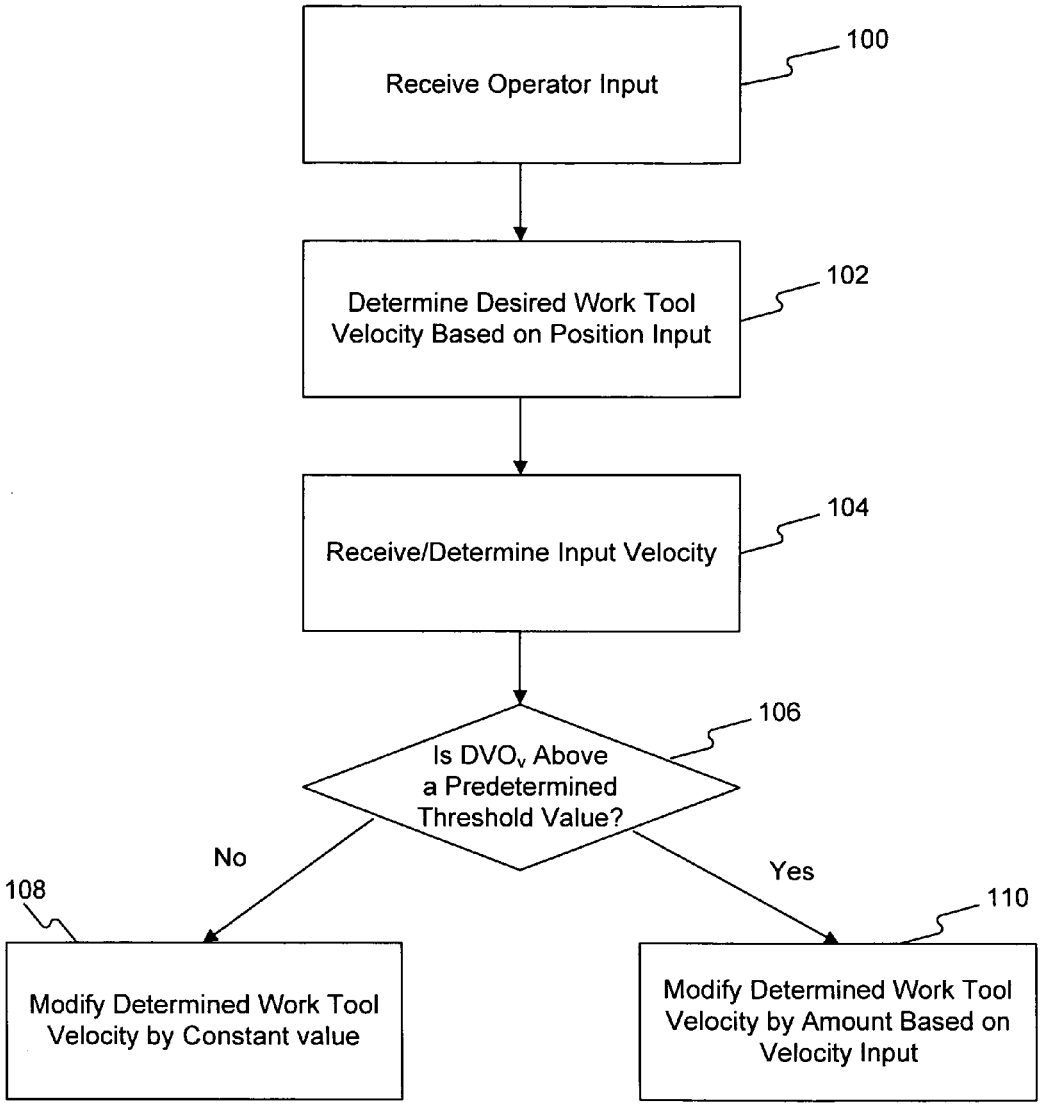
FIG. 3 is a flow chart illustrating an exemplary disclosed method of operating the control system of FIG. 2.

Controller 48 may receive input during operation of machine 10 and make determinations based on the input. As indicated in the flow chart of FIG. 3, controller 48 may receive the operator interface device position input signal (Step 100). Controller 48 may determine a desired work tool velocity based on the position input (Step 102). For example, an operator can move operator interface device from 0 to 50%, and this may correspond to 50% of maximum velocity.

Controller 48 may also receive or determine an input velocity, indicative of the speed at which the operator moves operator input device 22 (Step 104). Controller 48 may then determine, based on the input velocity, whether the desired work tool velocity is above a predetermined threshold value (Step 106).

For example, if an operator moves operator input device 22 from a neutral position or 0% of a maximum position, to a 50% position during a 2 second period, the input velocity (25%/sec) may be used in connection with Equation 1 to determine a desired work tool velocity offset value. This determined work tool velocity offset value may then be compared to a threshold offset value. If the desired work tool velocity offset value is below the predetermined threshold value, the work tool offset value may be limited to a predetermined constant value. In some situations, this constant value may be zero. Controller 48 may then determine desired velocities for the fluid actuator within hydraulic control system 24 as well as corresponding flow rate commands, based on the actuated position of operator interface device 22 and the corresponding desired velocity offset constant (Step 108). Controller 48 may then generate a command signal to be sent to the valve assembly corresponding to the modified desired fluid actuator velocity.

However, if the operator moves operator input device 22 faster such as, from the neutral position to the position representing 50% of the maximum in 0.1 seconds (i.e., the input velocity is 500%/sec), the determined desired work tool velocity offset value may be greater than the threshold value. If the desired work tool offset value is greater than the predetermined threshold, the velocity offset value may be proportional to the input velocity instead of constant, and utilized by controller 48 to modify the velocity value according to Equation 2 (Step 110). Controller 48 may then generate a command signal sent to the valve assembly corresponding to the modified desired fluid actuator velocity.

In some situations, it may be necessary to limit the maximum desired work tool velocity offset value. In these situations, controller 48 may compare the desired work tool velocity offset to a maximum threshold. If the desired work tool velocity offset value is greater than the maximum threshold, then the desired work tool velocity offset value may be limited to the threshold value. The limited value may then be used to calculate a modified desired work tool velocity.

It will be apparent to those skilled in the art that various modifications and variations can be made to the implement control system. Other embodiments will be apparent to those skilled in the art from consideration of the specification and practice of the disclosed implement control system. It is intended that the specification and examples be considered as exemplary only, with a true scope being indicated by the following claims and their equivalents.

What is claimed is:

1. A hydraulic control system for a machine having a work implement, the hydraulic control system comprising:

a fluid actuator configured to move the work implement;

an interface device movable by an operator to indicate a desired velocity of the work implement;

a sensor configured to generate a position signal indicative of a position of the interface device;

a valve assembly configured to regulate a hydraulic fluid flow to the fluid actuator to affect movement of the fluid actuator; and a controller in communication with the interface device, the sensor, and the valve assembly, the controller configured to:

determine a velocity input based on the position signal;

determine a velocity command based on the position signal;

selectively increase the velocity command based on the determined velocity input; and direct the increased velocity command to the valve assembly to move the work implement at the desired velocity.

2. The hydraulic control system of claim 1, wherein, if the determined velocity input is below a threshold value, the velocity command is increased by a minimum amount.

3. The hydraulic control system of claim 2, wherein, if the determined velocity input is above the threshold value, the command is increased by an amount proportional to the determined velocity input.

4. The hydraulic control system of claim 2, wherein the minimum amount is zero.

5. The hydraulic control system of claim 1, wherein the controller includes a map stored in a memory thereof relating the velocity command increase and the velocity input.

6. A method of operating a hydraulic system for a machine having a work implement, comprising:

receiving an interface device position signal;

determining a velocity input associated with the interface device position signal;

determining an implement velocity based on the interface device position signal;

determining an increase in the implement velocity based on the velocity input; and moving the work implement based on the increased implement velocity.

7. The method of claim 6, further including limiting the increase of the implement velocity to a minimum amount in response to the velocity input being below a threshold value.

8. The method of claim 7, wherein the increase includes an amount proportional to the velocity input, when the velocity input is above a threshold value.

9. The method of claim 7, wherein the minimum amount is zero.

10. A machine, comprising:

a work implement configured to perform a function in response to commands from an operator;

a fluid actuator configured to move the work implement;

an operator interface device movable by an operator to indicate a desired velocity of the work implement;

a sensor configured to generate a signal indicative of a displacement position of the interface device;

a valve assembly configured to regulate hydraulic fluid flow to the fluid actuator to affect movement of the fluid actuator; and a controller in communication with the interface device, the sensor, and the valve assembly, the controller being configured to:

determine a velocity input based on the signal; and based on both the signal and the determined velocity input, generate a command directed to the valve assembly that moves the work implement at a velocity higher than a velocity resulting from a command generated based on only the signal.

11. The machine of claim 10, wherein if the determined velocity input is below a threshold value, the command is a function of a constant minimum value.

12. The machine of claim 11, wherein if the determined velocity input is above the threshold value, the command is proportional to the determined velocity input.

13. The machine of claim 10, wherein the controller includes a map stored in a memory thereof relating the desired fluid actuator velocity and the command.

14. The machine of claim 10, wherein the command directed to the valve assembly is generated based only on the signal when the determined velocity input is below a threshold amount.

* * * * *